US006863274B2

(12) United States Patent
Webb

(10) Patent No.: US 6,863,274 B2
(45) Date of Patent: Mar. 8, 2005

(54) METHOD AND APPARATUS FOR PLAYING BLACKJACK WITH A FIVE CARD POKER WAGER ("21+5")

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 20 days.

(21) Appl. No.: 10/368,412

(22) Filed: Feb. 20, 2003

(65) Prior Publication Data

US 2004/0164491 A1 Aug. 26, 2004

(51) Int. Cl.[7] ..... A63F 1/00
(52) U.S. Cl. ..... 273/274; 273/292
(58) Field of Search ..... 273/292, 274, 273/309; 463/12, 13

(56) References Cited

U.S. PATENT DOCUMENTS

| | | | |
|---|---|---|---|
| 4,614,342 | A | 9/1986 | Takashima |
| 4,743,022 | A | 5/1988 | Wood |
| 4,836,553 | A | 6/1989 | Suttle et al. |
| 4,861,041 | A | 8/1989 | Jones et al. |
| 5,022,653 | A | 6/1991 | Suttle et al. |
| 5,046,736 | A | 9/1991 | Bridgeman et al. |
| 5,098,107 | A | 3/1992 | Boylan et al. |
| 5,174,579 | A | 12/1992 | Griffiths |
| 5,257,784 | A | 11/1993 | Boylan et al. |
| 5,257,810 | A | 11/1993 | Schorr et al. |
| 5,265,877 | A | 11/1993 | Boylan et al. |
| 5,275,415 | A | 1/1994 | Wisted |
| 5,288,081 | A | 2/1994 | Breeding |
| 5,294,128 | A | 3/1994 | Marquez |
| 5,308,065 | A | 5/1994 | Bridgeman et al. |
| 5,366,228 | A | 11/1994 | Kangsanaraks |
| 5,377,973 | A | 1/1995 | Jones et al. |
| 5,377,993 | A | 1/1995 | Josephs |

(List continued on next page.)

FOREIGN PATENT DOCUMENTS

GB 667345 2/1952

OTHER PUBLICATIONS

Copyright Filing with the Bureau voor de Intellectuele Eigendom, Aruba, 13 pgs. (Jan. 13, 1988.)
Published Rule Sheet for Casino Poker from Vegas World, 1 page, 1982.
"Card Craps", Scarne's Encyclopedia of Card Games, pp.321–323, 1948.
"Over/Under 13", Gaming Concepts, Inc., 1998.
Scarne, John, "Scarne's Encyclopedia of Games", Harper & Row, Publishers, pp. 278–281.

*Primary Examiner*—William M. Pierce
(74) *Attorney, Agent, or Firm*—Nixon & Vanderhye P.C.

(57) ABSTRACT

A card game combines the play of Blackjack ("21") with a 5-card Poker wager or side bet ("21+5"). Each player places a basic Blackjack wager for each of two hands and an optional side wager before the cards are dealt. Each player is then dealt a card for each hand with the dealer receiving a face-up card. Each player is dealt a second card for each hand. At this point, the outcome of each 5-card hand is determined, where a 5-card hand consists of the two 2-card hands dealt to that player and the dealer's face-up card. After settling the 5-card wagers, the game of Blackjack continues in a typical fashion. The invention advantageously retains all the features and advantages of Blackjack as well as provides the dynamics of a proposition game, without interfering with the card sequence, for enhanced player anticipation and enjoyment.

16 Claims, 1 Drawing Sheet

U.S. PATENT DOCUMENTS 5,397,128 A 3/1995 Hesse et al.
5,431,408 A 7/1995 Adams
5,489,101 A 2/1996 Moody
5,505,449 A 4/1996 Eberhardt et al.
5,538,252 A 7/1996 Green
5,569,082 A 10/1996 Kaye
5,584,486 A 12/1996 Franklin
5,630,757 A 5/1997 Gagin et al.
5,653,444 A 8/1997 Dahl
5,673,917 A 10/1997 Vancura
5,678,821 A 10/1997 Hedman
5,685,774 A 11/1997 Webb
5,732,950 A 3/1998 Moody
5,743,530 A 4/1998 Sklad et al.
5,839,730 A 11/1998 Pike
5,873,571 A 2/1999 Vaisman et al.
6,012,719 A 1/2000 Webb
6,056,641 A 5/2000 Webb
6,237,916 B1 5/2001 Webb
6,293,551 B1 9/2001 Webb
6,371,867 B1 4/2002 Webb
6,481,717 B1 * 11/2002 Richardelle ..... 273/292
6,481,719 B2 11/2002 Webb
6,523,831 B2 2/2003 Webb
6,749,200 B2 * 6/2004 Yurkins ..... 273/292

* cited by examiner

METHOD AND APPARATUS FOR PLAYING BLACKJACK WITH A FIVE CARD POKER WAGER ("21+5")

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The invention relates to card games. More particularly, the invention relates to Blackjack variant card games.

With the expansion of gaming and the increase in competition, casinos are striving to offer a wider variety of games. The growth in slot machine popularity and the increase in variety of specialty games has resulted in the overall reduction in conventional Blackjack ("21") tables.

Many casinos, however, are reluctant to further reduce the number of Blackjack tables because of the inherent game attractiveness to both players and casinos. The game is based on simple concepts and procedures that are readily understood by casual and regular players alike. In addition, the game allows players to use basic strategies that provide some degree of player control and that allow for heightened excitement. For the casino operators, the game requires relatively low overhead to facilitate and monitor.

In an attempt to accommodate the desire for variety and the retention of a significant Blackjack presence, several Blackjack variant games have been introduced. These games include Multiple Action Blackjack, Spanish 21, Face-Up 21, and Royal Match. See, e.g., U.S. Pat. No. 5,673,917 to Vancura. Although Blackjack variants typically provide additional waging options, these games tend to either negatively alter the flow of the Blackjack game or add very little game dynamics. Another Blackjack variant is Action Gaming's 21 Stud. In this game, each player has the option of placing a side wager in addition to the basic Blackjack wager. The side wager is a bet that a dealer's 5-card hand will be above a certain rank and has a variable payoff scale according to rank. Since a Blackjack player may be satisfied with a hand before being dealt five cards (e.g., when the player is dealt an Ace and a Jack for the first two cards), 21 Stud provides for a dealer settling all Blackjack wagers after standing or busting. The game then allows the dealer to draw extra cards, if necessary until having a total of five cards. The dealer's first five cards form a Poker hand. A standing hand occurs on the odd occasions that more than five cards were required for the dealer to reach 17 or more.

21 Stud, however, has several drawbacks. Firstly, because all players with the side wager are betting on the same outcome, the game is very volatile. Secondly, with the range of payoff odds required with a 5-card game, there is a risk of a high payoff amount. Accordingly, the game will likely never be offered with a $1 side bet and may require extra surveillance. Thirdly, the Blackjack hand is the primary part of the game for the majority of players. However, Blackjack wagers are settled first, so the potential anticipatory thrill time is lower on the primary wager. Fourthly, when 5-card hands are dealt face-up, one at a time, there is usually very little excitement because after three cards it is often obvious that a premium hand cannot be created. For example when the first three cards dealt are 10, 5, and 2 (off-suit), no straight, flush, full house or better are possible. Fifthly, and probably most significantly, the dealer is usually required to take extra cards. This aspect of the game is particularly problematic because it slows the game down and deters potential players who are generally adverse to waiting for other players or the dealer to take additional cards and those potential players who do not like the run of cards to be altered.

BRIEF SUMMARY OF THE INVENTION

The invention is an expansion of U.S. Pat. No. 6,012,719 (the contents of which are hereby incorporated by reference) and provides card games that combine the play of Blackjack ("21") with a 5-card Poker wager ("21+5"). In a casino embodiment, the invention can be played in conjunction with a conventional Blackjack casino-type table and a single standard deck of 52 playing cards. The table surface not only has the regular Blackjack bet areas, but also an extra bet area for an optional 5-card side wager. In such an embodiment, the table also displays a payoff scale on the side wager and further instructional and promotional information.

At the beginning of a game, each player places two basic Blackjack wagers for two Blackjack hands and an optional 5-card side wager. A dealer deals each player a card for each hand, with the dealer receiving a face-up card. Each player also receives a second card for each hand. A player's 5-card hand consists of the two 2-card hands dealt to that player and the dealer's face-up card. At this point, the outcomes of the 5-card hands are determined. In one embodiment of the invention, Poker rankings such as a pair or better ("Pair Plus") or two pair or better are used to determine a winning hand. After settling the side wagers, the game of Blackjack continues.

The invention advantageously retains all the features and advantages of Blackjack (and Blackjack variants) as well as provides the dynamics of a 5-card side wager, without interfering with the card sequence, for enhanced player anticipation and enjoyment. The invention thus benefits the player who desires a Pair Plus or proposition type of game as well as the player who does not want to leave a Blackjack game, but desires some variety. In addition, the invention provides casino operators with added revenue generating features without requiring additional casino tables, space, or extra game surveillance.

The invention can be readily implemented in a wide variety of additional forms and media including single player slot video machines, multi-player slot video machines, electronic games and devices, lottery terminals, scratch-card formats, software as well as in-flight, home, and Internet entertainment. Moreover, the invention can be readily implemented in software, which can be stored on a disk (e.g., magnetic disk, compact disc (CD), etc.) and used with a computer system.

The foregoing, and other features and advantages of the invention, will be apparent from the following, more particular description of the preferred embodiments of the invention, the accompanying drawing, and the appended claims.

BRIEF DESCRIPTION OF THE DRAWINGS

FIG. 2 is a flow chart illustrating the game method steps.

DETAILED DESCRIPTION OF THE INVENTION

Figure 1:
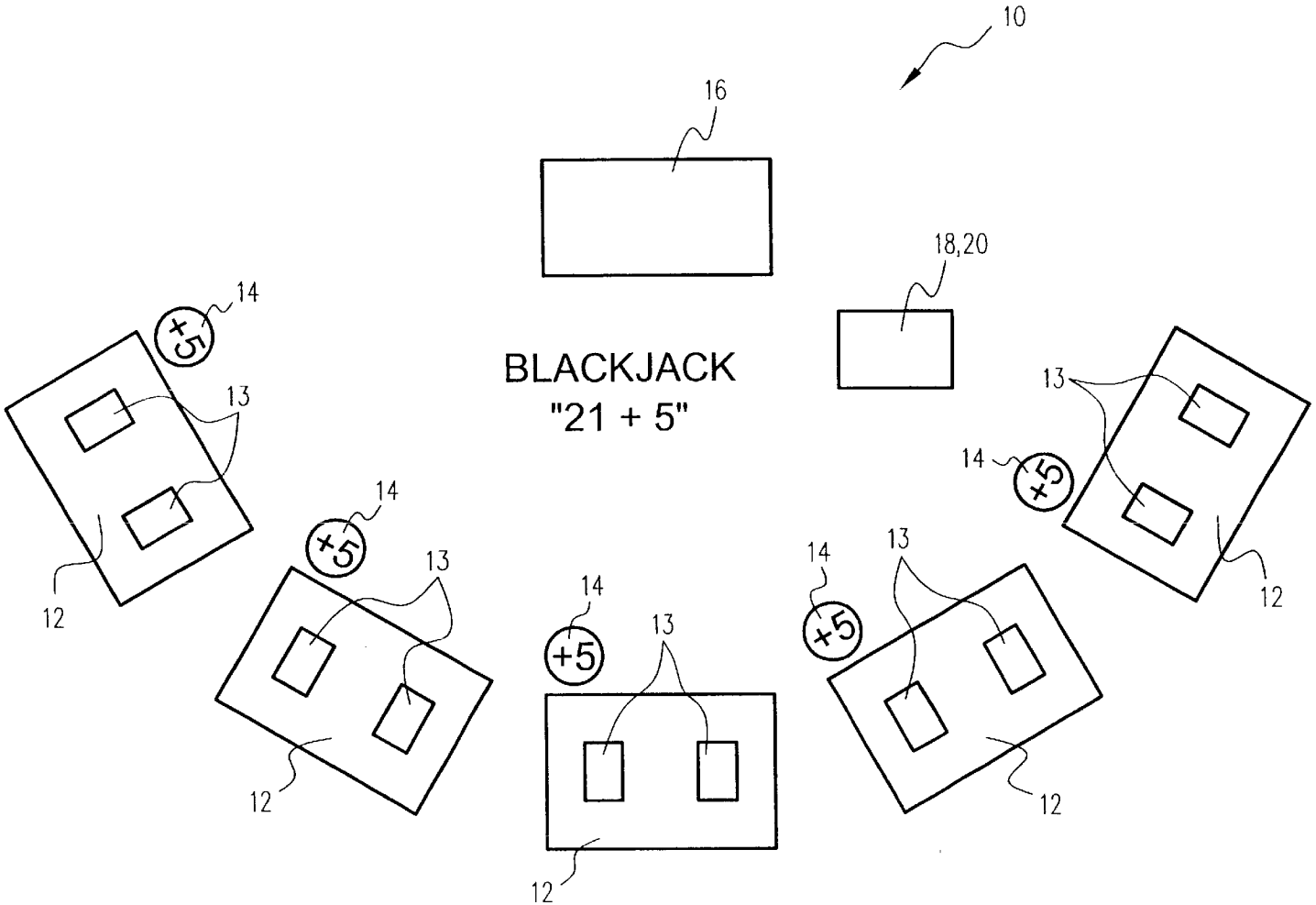
FIG. 1 illustrates a playing surface (layout) of a casino-type table in accordance with the invention.

The invention provides card games that combine the play of Blackjack ("21") with a 5-card Poker side wager ("21+

5"). A preferred embodiment of the invention is used in connection with a casino-type Blackjack table and one or more standard decks of 52 playing cards. FIG. 1 illustrates a playing surface (layout) 10 of the Blackjack table which includes a primary betting area 12 for each of a plurality of players, which in this embodiment is five players. Primary betting area 12 includes two wager areas 13 for the placement of a Blackjack wager on each of two hands. According to the present invention, in order to place the Poker side wager, each player is required to play and wager on two Blackjack hands. Playing surface 10 also includes a secondary betting area 14, corresponding with each area 12, for an optional 5-card side wager. In addition, playing surface 10 includes a dealer area 16, displays of a predetermined payoff scale 20, and displays of predetermined game rules 18. As would be apparent to one skilled in the relevant art, the predetermined payoff scales and game rules used in a particular embodiment can be based on the teachings of the invention and well known gaming principles and casino specific requirements. Other wager areas and/or information can be displayed on playing surface 10, such as the "21+5" promotional markings illustrated in FIG. 1.

With reference to FIG. 2, in this preferred embodiment, each player must place at least one Blackjack wager at betting area 12 in order to participate in the game and two Blackjack wagers at betting area 12 in order to place the 5-card side wager. Each player who placed two Blackjack wagers then has the option to place an additional 5-card side wager at betting area 14. In another embodiment of the invention, both the Blackjack and side wagers may be required. Additional wagers and wager features can be practiced with the invention as would be apparent to those of ordinary skill in the art.

The allowable limit of the side wagers (placed in area 14) is preferably governed by both predetermined game rules 20 and the Blackjack wagers (placed in area 12). For example, with each player having separate hands and with a payoff scale with a highest payoff similar to Craps or Roulette, an embodiment of the invention can be operated with a minimum side wager equal to a table minimum for Blackjack, typically $5 or more. In addition, a maximum side wager for a player can be set to the first hand side wager made by that player after each shuffle or at the beginning of that shoe. This would negate the impact of well known techniques such as card counting, shuffle tracking, and card locating used by proficient players.

Once the wagers have been placed, a dealer then deals, in rotation, each player a first card for each hand and the dealer receives a face-up card. Each player, again in rotation, is then dealt a second card for each hand and the dealer receives a second or hole card (face-down). Alternatively, the second face-down card can be retained in the deck. In accordance with the invention, a 5-card side wager hand consists of the two 2-card hands that player was dealt and the dealer's face-up card.

The outcomes of the 5-card wagers are then determined and settled prior to continuing with the Blackjack game. In one embodiment, a player wins the 5-card side wager according to Poker rankings with two pair or better. Alternatively or additionally, the 5-card side wager may be pushed (tied) if the 5-card hand has a Poker ranking of pair.

In either operating mode, payouts on winning 5-card side wagers may be based on a scale according to the Poker rank of the 5-card hand. That is, a higher Poker rank achieves a higher payout. For example, a Poker rank of two pair or some higher base rank may be paid 1 to 1 while a winning Poker rank of Royal Flush may be paid 40 to 1 or higher. Alternatively, a composite or fixed payout may be established for winning side wagers such that all 5-card hands having a Poker rank exceeding a predetermined Poker rank, such as two pair or three of a kind or higher, are paid the same payout. The fixed payout may be 1 to 1 or higher.

The 5-card wagers are now settled. If the player has a losing 5-card hand, their bet (from area 14) is removed. If the player has a winning 5-card Poker hand, they are paid in accordance with the predetermined game rules, predetermined payoff scale or composite payoff, and the amount of their bet placed in area 14. As would be apparent to one skilled in the relevant art, alternative payoff scales (e.g., in accordance with the particular casino requirements) can be practiced with the invention.

In an alternative embodiment according to the present invention, a player wins the 5-card side wager according to a predetermined defining criteria. For example, a player may win the 5-card side wager when all five cards or four out of five cards are the same color. Other examples may include a number of cards being face cards (i.e., Jacks, Queens or Kings), a number of cards being higher than a certain number such as 9, a number of cards being lower than a certain number such as 6, etc. Those of ordinary skill in the art will contemplate many viable alternatives for the defining criteria, and the invention is not necessarily meant to be limited to one particular criteria.

After settling the 5-card wagers, the dealer proceeds with a Blackjack game. In this embodiment, the Blackjack game is conventional. However, other variant Blackjack games can be practiced with the invention. The Blackjack wagers are settled in accordance with well known principles and the particular aspects of the Blackjack (or Blackjack variant) game.

The invention advantageously retains all of the features and advantages of Blackjack as well as provides the dynamics of a proposition game side wager, without interfering with the card sequence, for enhanced player anticipation and enjoyment. The invention thus benefits the player who desires a Poker type or proposition game as well as the player who does not want to leave a Blackjack game, but desires some variety. In addition, the invention provides casino operators with additional revenue generating features for Blackjack with acceptable volatility.

Another predominate feature of the invention is that casino embodiments of the invention do not require additional space or tables to practice the invention, rather the invention can be practiced with existing tables, preferably modified as illustrated in FIG. 1.

An additional feature is that the invention does not require any more game surveillance than a conventional Blackjack game.

As would be apparent to one skilled in the relevant art, the invention can be embodied in a wide variety of forms and media including, but not limited to, single player slot video machines, multi-player slot video machines, electronic games and devices, lottery terminals, scratch-card formats, software as well as in-flight, home, and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing a card game comprising:

(a) dealing two 2-card hands to a player and at least one card to a dealer;

(b) forming a 5-card hand including cards from the two 2-card hands dealt to the player and the at least one card dealt to the dealer;

(c) resolving the 5-card hand according to a Poker rank of the 5-card hand; and (d) continuing with a Blackjack game.

2. A method according to claim 1, further comprising, prior to step (a), the step of receiving a side wager from the player.

3. A method according to claim 2, wherein step (c) is practiced by paying a payout based on the side wager when the Poker rank of the 5-card hand matches or exceeds a predetermined Poker rank.

4. A method according to claim 3, wherein the predetermined Poker rank is pair.

5. A method according to claim 4, wherein when the Poker rank of the 5-card hand is pair, step (c) is practiced by pushing the side wager.

6. A method according to claim 3, wherein the predetermined Poker rank is at least two pair.

7. A method according to claim 3, wherein step (c) is further practiced by paying the payout on a scale according to the Poker rank of the 5-card hand.

8. A method according to claim 3, wherein step (c) is further practiced by paying a fixed payout based on the side wager.

9. A method of combining a Blackjack game and a Poker side game in a casino environment, the method comprising:

(a) receiving at least a first wager from a player to participate in the Blackjack game;

(b) receiving an optional second wager to participate in the Poker side game;

(c) dealing two 2-card Blackjack hands to the player and at least one card to a dealer;

(d) forming a 5-card hand including cards from the two 2-card hands dealt to the player and the at least one card dealt to the dealer;

(e) if the player placed the second wager, resolving the 5-card hand according to a Poker rank of the 5-card hand; and (f) continuing with a Blackjack game.

10. A method according to claim 9, wherein step (e) is practiced by paying a payout based on the second wager when the Poker rank of the 5-card hand matches or exceeds a predetermined Poker rank.

11. A method according to claim 10, wherein the predetermined Poker rank is pair.

12. A method according to claim 11, wherein when the Poker rank of the 5-card hand is pair, step (e) is practiced by pushing the second wager.

13. A method according to claim 10, wherein the predetermined Poker rank is two pair.

14. A method according to claim 10, wherein step (e) is further practiced by paying the payout on a scale according to the Poker rank of the 5-card hand.

15. A method according to claim 10, wherein step (e) is further practiced by paying a fixed payout based on the side wager.

16. An apparatus for playing a card game comprising:

means for dealing two 2-card hands to a player and at least one card to a dealer;

means for forming a 5-card hand including cards from the two 2-card hands dealt to the player and the at least one card dealt to the dealer;

means for resolving the 5-card hand according to a Poker rank of the 5-card hand; and means for continuing with a Blackjack game.

* * * * *